US006949730B2

(12) United States Patent
Lee et al.

(10) Patent No.: US 6,949,730 B2
(45) Date of Patent: Sep. 27, 2005

(54) WALL-MOUNTED TYPE MICROWAVE OVEN

(75) Inventors: Se-Hun Lee, Incheon (KR); Kwang-il Yang, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 138 days.

(21) Appl. No.: 10/309,816

(22) Filed: Dec. 5, 2002

(65) Prior Publication Data

US 2004/0000549 A1 Jan. 1, 2004

(30) Foreign Application Priority Data

Jun. 29, 2002 (KR) ..... 2002-37611

(51) Int. Cl.[7] ..... H05B 6/64

(52) U.S. Cl. ..... 219/758; 219/756; 362/92; 126/299 R

(58) Field of Search ..... 219/758, 757, 219/756, 702, 739; 362/92, 116, 190, 191, 202, 208, 464, 594; 126/21 R–21 A, 299 R, 299 D, 211, 300; 292/DIG. 61, 19

(56) References Cited

U.S. PATENT DOCUMENTS 4,742,434 A * 5/1988 Furui et al. ..... 362/549
4,853,508 A * 8/1989 Hammerl ..... 219/758
5,149,930 A * 9/1992 Levoska et al. ..... 219/758
6,658,829 B2 * 12/2003 Iida et al. ..... 56/10.5

FOREIGN PATENT DOCUMENTS

KR 10-0224446 7/1999

* cited by examiner

*Primary Examiner*—Quang T Van
(74) *Attorney, Agent, or Firm*—Staas & Halsey LLP

(57) ABSTRACT

A wall-mounted type microwave oven has an improved assembling structure of a lighting device to afford reduction of manufacturing cost and ease of assembly. The lighting device includes an opening formed at a bottom panel of the microwave oven, a lamp housing mounted on the bottom panel to cover the opening and having a lamp therein, a window bracket provided at the opening and having a transparent window thereon, support pieces provided at the bottom panel and extended toward the lamp housing, hooks formed at either the support pieces or the lamp housing, and hook holes formed at another of the support pieces and the lamp housing, coupling plates provided at the lamp housing and the window bracket, coupling holes formed at the coupling plates of the lamp housing and the window bracket, and a screw to be tightened into the coupling holes.

13 Claims, 5 Drawing Sheets

WALL-MOUNTED TYPE MICROWAVE OVEN

CROSS-REFERENCE TO RELATED APPLICATION

This application claims the benefit of Korean Application No. 2002-37611, filed Jun. 29, 2002, in the Korean Intellectual Property Office, the disclosure of which is incorporated herein by reference.

BACKGROUND OF THE INVENTION

1. Field of the Invention

The present invention relates to a wall-mounted type microwave oven, and more particularly, to a wall-mounted type microwave oven having a lighting device to illuminate kitchen areas disposed therebelow.

2. Description of the Related Art

Generally, a wall-mounted type microwave oven is mounted on a kitchen wall over a gas oven, and not only carries out a cooking operation, but also exhausts gas and fumes generated from the gas oven disposed below the wall-mounted microwave oven.

As shown in FIG. 1, such a wall-mounted type microwave oven includes an oven body 1, which defines an outer contour of the microwave oven. The oven body 1 has a cooking chamber 1*a* and an electric component compartment 1*b* on a left side and a right side, respectively, of the inside thereof, which are isolated from each other. An exhaust flow path 1*c* is defined between outer surfaces of the cooking chamber 1*a* and the electric component compartment 1*b* and the oven body 1 to allow gas and fumes generated from a gas oven (not shown) disposed below the oven body 1 to be exhausted therethrough. The exhaust flow path 1*c* is disposed around the cooking chamber 1*a* and the electric component compartment 1*b*. A bottom panel 1*d* of the oven body 1 is provided at respective opposite sides with intake ports 1*e* so as to allow the gas and fumes existing below the oven body 1 to be introduced into the oven body 1 therethrough. The oven body 1 is provided at an upper portion thereof with an exhaust fan 1*f* to discharge the gas and fumes, introduced into the oven body 1 through the intake ports 1*c* and an exhaust flow path 1*c*, to an outside.

A pair of lighting devices 2 is provided in the exhaust flow path 1*c* below the cooking chamber 1*a* and the electric component compartment 1*b* to illuminate kitchen areas disposed below the oven body 1.

As shown in FIG. 2, each of the lighting devices 2 includes an opening 3 formed at the bottom panel 1*d* of the oven body 1 to allow light from the lighting device 2 to be emitted downward therethrough, a lamp housing 4 mounted on the bottom panel 1*d* to cover the opening 3 and having a lamp 4*a* supported by an inner wall thereof, and a window bracket 5 provided in the opening 3 and having a transparent window 5*a* thereon.

The lamp housing 4 is formed in a box shape with one open side facing the opening 3. Left wall 4*b* and right wall 4*c* of the lamp housing 4 are formed with a coupling hole 4*d* and a first coupling hole 4*e* coupling the lamp housing 4 to the bottom panel 1*d*.

The bottom panel 1*d* is provided at respective opposite ends of the opening 3 with first and second support pieces 6 and 7, which are extended upwardly to support the left and right walls 4*b* and 4*c* of the lamp housing 4. The first support piece 6 corresponds to the left wall 4*b* of the lamp housing 4 and includes a coupling protrusion 6*a* to be fitted into the coupling hole 4*d* of the lamp housing 4, while the second support piece 7 corresponds to the right wall 4*c* of the lamp housing 4 and includes a second coupling hole 7*a* into which a screw 9, passed through the first coupling hole 4*e* of the right wall 4*c* is tightened. The second support piece 7 is provided with a third coupling hole 7*c* below the second coupling hole 7*a*, which corresponds to a fourth coupling hole 5*b* of the window bracket 5, and the second support piece 7 is provided with a rib 7*b* which is extended inwardly.

The window bracket 5 is provided at one end thereof with a pair of hanger protrusions 5*c* hanging on the first support piece 6, and the window bracket is provided at the other end with a fastening portion 5*d*, which is adapted to be in contact with the rib 7*b* of the second support piece 7 and has the fourth coupling hole 5*b* of the second support piece 7 corresponding to the third coupling hole 7*c*.

An operation of assembling the lighting device will now be described. First, the window bracket 5 is inserted into the opening 3 of the bottom panel 1*d*, and the pair of hanger protrusions 5*c* of the window bracket 5 is hung on the first support piece 6. Further, the coupling protrusion 6*a* of the first support piece 6 is fitted into the coupling hole 4*d* of the left wall 4*b* of the lamp housing 4. The lamp housing 4 is rotated toward the second support piece 7 about the coupling protrusion 6*a* until the right wall 4*c* of the lamp housing 4 comes into close contact with the second support piece 7. Thereafter, the screw 9 is tightened into the second coupling hole 7*a* of the second support piece 7 through the first coupling hole 4*e* of the lamp housing 4 to fix the lamp housing 4 to the bottom panel 1*d*. The window bracket 5 is rotated about the hanger protrusions 5*c* until the fastening portion 5*d* of the window bracket 5 comes into contact with the rib 7*b* of the second support piece 7. Subsequently, the screw 9 is tightened into the third coupling hole 7*c* of the second support piece 7 through the fourth coupling hole 5*b* of the fastening portion 5*d* to fix the window bracket 5 to the bottom panel 1*d*, thereby completing the assembly of the lighting device.

However, since an assembling operation of the lighting device 2 of the conventional wall-mounted type microwave oven requires that two screws 9 be tightened in order to couple the lamp housing 4 to the bottom panel 1*d* of the oven body 1 and to couple the window bracket 5 to the bottom panel 1*d*, manufacturing cost and manufacturing time are increased due to an increase in a number of the screws 9 used, thereby deteriorating productivity.

SUMMARY OF THE INVENTION

Accordingly a wall-mounted type microwave oven, in which an assembling structure of a lighting device is improved to afford a reduction of manufacturing cost and ease of assembly.

Additional aspects and advantages of the invention will be set forth in part in the description which follows and, in part, will be obvious from the description, or may be learned by practice of the invention.

In order to accomplish the above and other aspects, a wall-mounted microwave oven comprising: an oven body having a bottom panel; and a lighting device comprising: an opening formed at the bottom panel; a lamp housing mounted on the bottom panel to cover the opening and having a lamp therein; a window bracket provided at the opening and having a transparent window thereon; a holding unit to temporarily hold the lamp housing on the bottom panel; and a coupling unit to couple the window bracket to the lamp housing.

The lighting device may include two or more support pieces provided at the bottom panel adjacent to respective opposite ends of the opening and extended toward the lamp housing, and the holding unit may comprise hooks formed at the lamp housing or the two or more support pieces, and hook holes formed at a remaining one of the lamp housing and the support pieces.

The lighting device may include coupling plates provided at the lamp housing and the window bracket, and the coupling unit may comprise coupling holes formed at the coupling plates provided at the lamp housing and the window bracket, and a screw to be tightened into the coupling holes.

BRIEF DESCRIPTION OF THE DRAWINGS

These and other aspects and advantages of the invention will become apparent and more readily appreciated from the following description of the preferred embodiments, taken in conjunction with the accompanying drawings of which.

DESCRIPTION OF THE PREFERRED EMBODIMENTS

Figure 1:
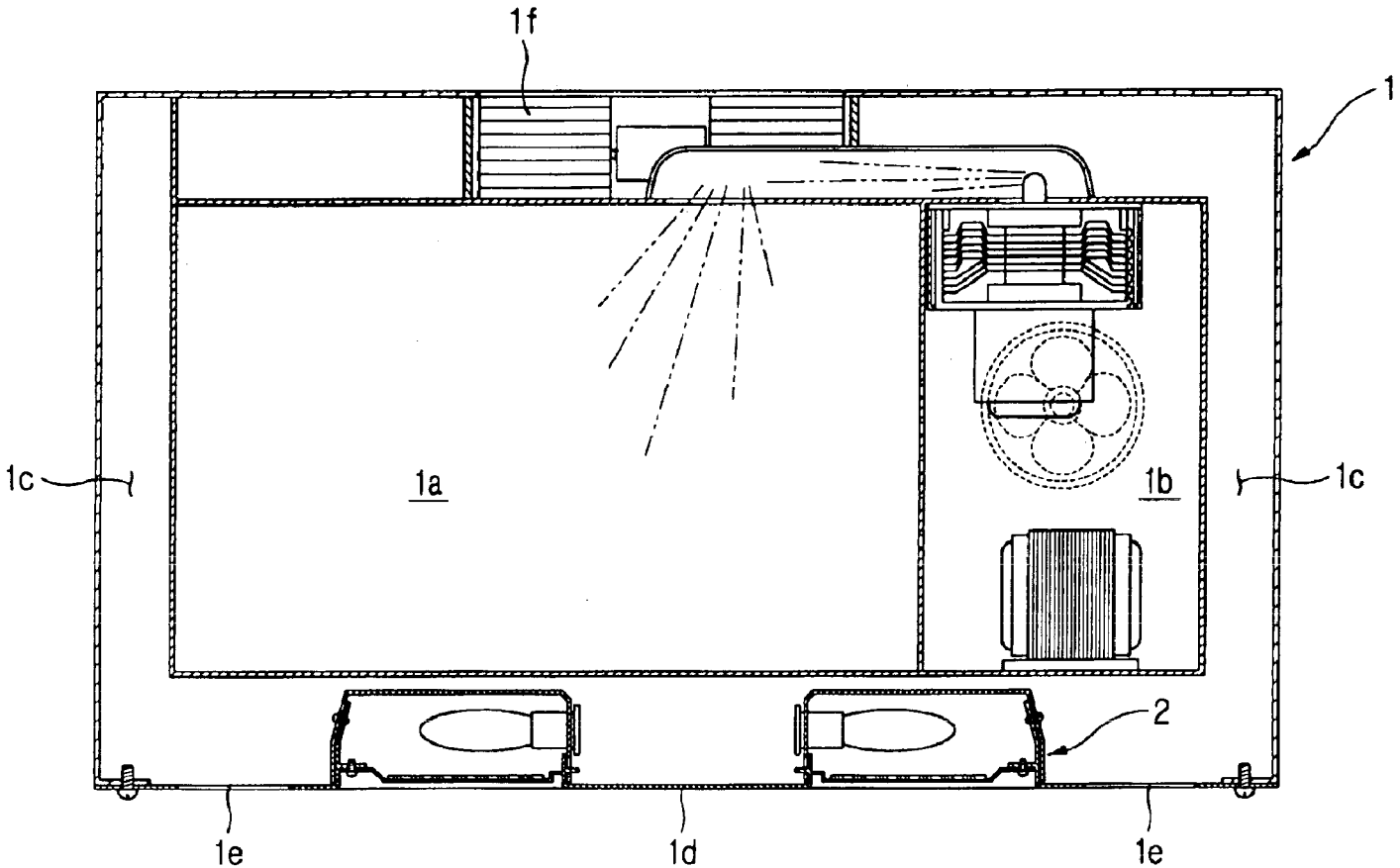
FIG. 1 (PRIOR ART)
FIG. 1 is a cross-sectional view of a conventional wall-mounted type microwave oven.
Figure 2:
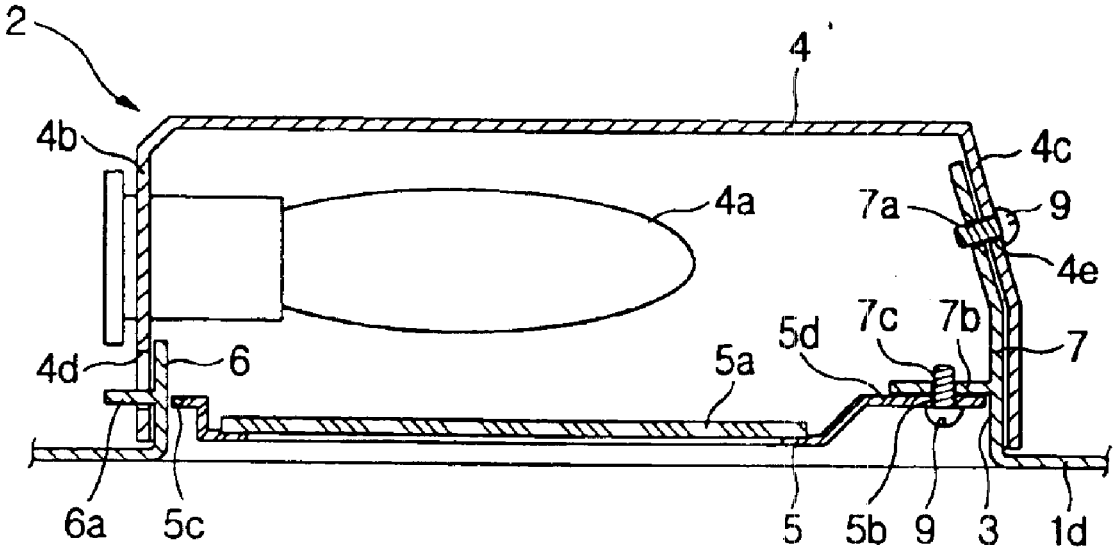
FIG. 2 (PRIOR ART)
FIG. 2 is a cross-sectional view of the conventional lighting device of the wall-mounted type microwave oven of FIG. 1.

Reference will now made in detail to the present preferred embodiments of the present invention, examples of which are illustrated in the accompanying drawings, wherein like reference numerals refer to the like elements throughout. The embodiments are described below in order to explain the present invention by referring to the figures.

Figure 3:
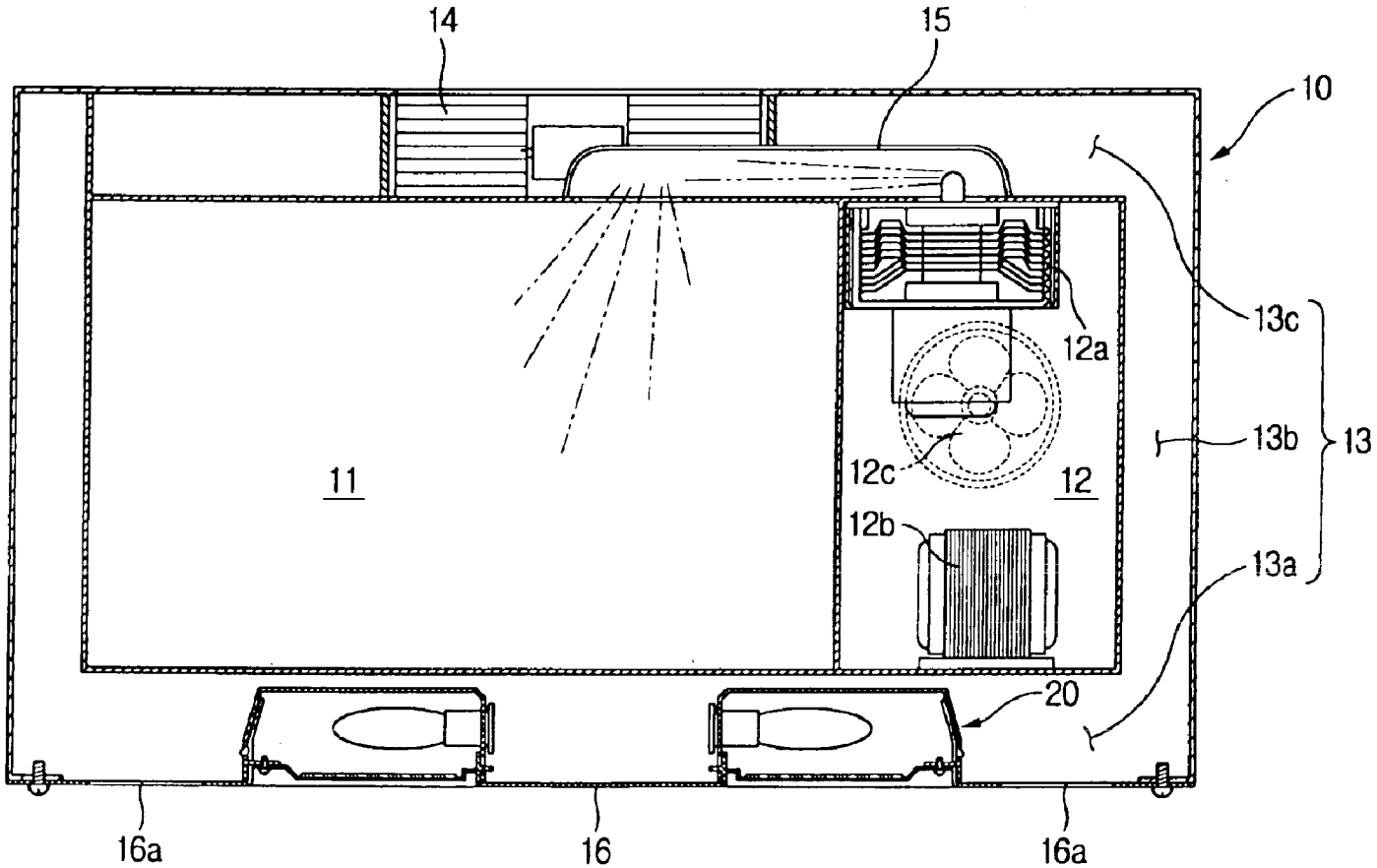
FIG. 3 is a cross-sectional view of a wall-mounted type microwave oven according to an embodiment of the present invention.

As shown in FIG. 3, a wall-mounted type microwave oven includes an oven body 10, which is divided by a partition plate into a cooking chamber 11 to cook food therein and an electric component compartment 12 which accommodates various electric components. The oven body 10 is provided therein with an exhaust flow path 13, which is isolated from the cooking chamber 11 and the electric component compartment 12, to exhaust gas and fumes generated from food being cooked on a gas oven (not shown) disposed below the oven body 10. The oven body 10 is provided at an upper and rear portion thereof with an exhaust fan assembly 14 to discharge the gas and fumes introduced into the exhaust flow path 13.

The electric component compartment 12 is equipped with a magnetron 12*a* generating high-frequency electromagnetic waves guided into the cooking chamber 11, a high voltage transformer 12*b* applying high voltage to the magnetron 12*a*, and a cooling fan 12*c* cooling the electric component compartment 12. The magnetron 12*a* is disposed at an upper portion of the electric component compartment 12, and the high voltage transformer 12*b* is mounted on a bottom surface of the electric component compartment 12. A waveguide 15 is disposed on the cooking chamber 11 and the electric component compartment 12 to guide high-frequency electromagnetic waves, generated by the magnetron 12*a*, into the cooking chamber 11. The oven body 10 is provided at a front face thereof with a door (not shown) and a control panel (not shown), such that the door is openably coupled to the oven body 10 to close the cooking chamber 11, and the control panel is disposed on the front face of the electric component compartment 12. The control panel includes a plurality of control buttons controlling various functions of the microwave oven and a display displaying operational conditions of the microwave oven.

The exhaust flow path 13 comprises a lower path section 13*a* defined between bottom surfaces of the cooking chamber 11 and the electric component compartment 12 and a bottom panel 16 of the oven body 10, two rising path sections 13*b* vertically disposed beside the cooking chamber 11 and the electric component compartment 12, respectively, and an upper path section 13*c* disposed between upper surfaces of the cooking chamber 11 and the electric component compartment 12 and the top of the oven body 10 to guide the gas and fumes, introduced into the rising path sections 13*b*, to the exhaust fan assembly 14. The bottom panel 16 of the oven body 10 is formed with a pair of intake ports 16*a* to allow the gas and fumes existing therebelow to be introduced into the oven body 10. Thus, the gas and fumes are introduced into the oven body 10 through the intake ports 16*a*, and then discharged from the oven body 10 through the lower path section 13*a*, the rising path sections 13*b* and the upper path section 13*c*, when the exhaust fan assembly 14 is operated.

A pair of lighting devices 20 are provided in the exhaust flow path 13*a* below the cooking chamber 11 and the electric component compartment 12 to illuminate kitchen areas on which a gas oven (not shown) is placed.

Figure 4:
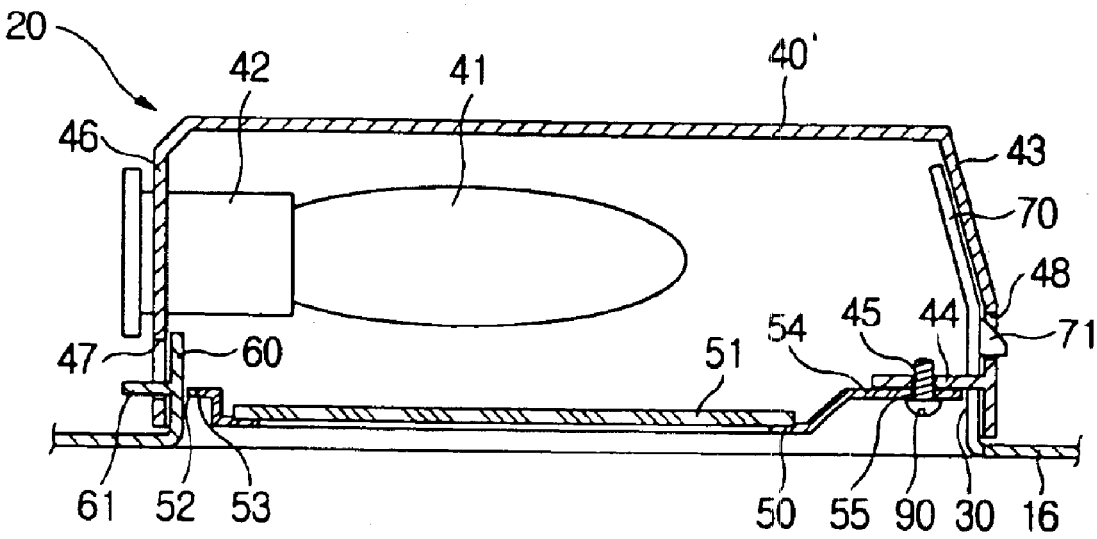
FIG. 4 is a cross-sectional view of a lighting device of the wall-mounted type microwave oven of FIG. 3.
Figure 5:
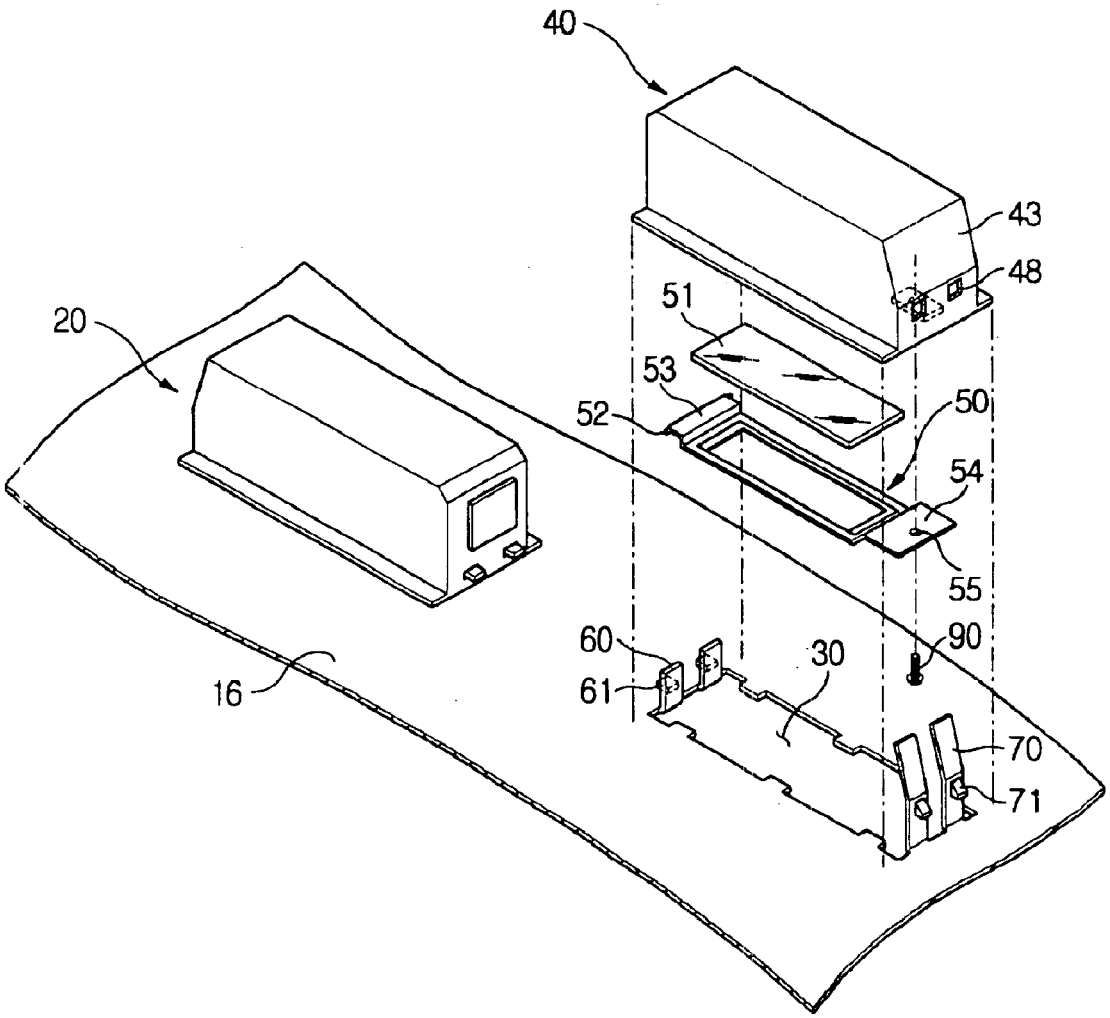
FIG. 5 is an exploded perspective view of the lighting device of the wall-mounted type microwave oven of FIG. 3.

As shown in FIGS. 4 and 5, each of the lighting devices 20 includes an opening 30 formed at the bottom panel 16 of the oven body 10 to allow light from the lighting device 20 to be emitted downward therethrough, a lamp housing 40 mounted on the bottom panel 16 to cover the opening 30 and having a lamp 41 supported by an inner wall thereof, and a window bracket 50 provided in the opening 30 and having a transparent window 51 thereon. The lamp 41 is supported by the lamp housing 40 such that a lamp socket 42 is inserted into the lamp housing 40 and the lamp 41 is fitted into the lamp socket 42. The transparent window 51 is attached to the window bracket 51 by adhesive.

The lamp housing 40 is formed in a box shape with one lower side open. The lower open side of the lamp housing 40 is designed to be larger than that of the opening 30 of the bottom panel 16 so as to prevent the lamp housing 40 from falling through the opening 30. A right wall 43 of the lamp housing 40 is provided at a lower end of the right wall 43 with a first coupling plate 44, which is extended inwardly. The first coupling plate 44 is formed with a first hole 45 to allow a screw 90 to pass therethrough.

The bottom panel 16 is provided at respective ends of the opening 30 with a pair of first support pieces 60 and a pair of second support pieces 70. The pair of first support pieces 60 is disposed at a left side of the opening 30 to support a left wall 46 of the lamp housing 40, and the pair of second support pieces 70 is disposed at a right side of the opening 30 to support the right wall 43 of the lamp housing 40.

The pair of the first support pieces 60 is provided at outer surfaces thereof with coupling protrusions 61, respectively. The left wall 46 of the lamp housing 40 is formed with a pair of coupling holes 47 into which the coupling protrusions 61 of the pair of first support pieces 60 are fitted. The second support pieces 70 are provided at outer surfaces thereof with hooks 71, respectively, and the right wall 43 of the lamp housing 40 is formed with a pair of hook holes 48 corresponding to the hooks 71. Each of the coupling holes 47 of the lamp housing 40 is designed to be somewhat larger than that of each of the coupling protrusions 61 to allow the lamp housing 40 to be rotated about the coupling protrusions 61. Accordingly, even though the coupling protrusions 61 of a respective first support piece 60 are fitted into a respective coupling hole 47, the lamp housing 40 is rotated so that the hooks 71 of the second support pieces 70, respectively, are engaged with respective hook holes 48 of the lamp housing 40, thereby enabling the right wall 43 of the lamp housing 40 to be supported by the second support pieces 70.

The window bracket 50 is provided at one end thereof with a hinge part 53 having a pair of hanger protrusions 52, and is provided at another end thereof with a second coupling plate 54 corresponding to the first coupling plate 44 of the lamp housing 40. The second coupling plate 54 includes a second coupling hole 55 corresponding to the first coupling hole 45. The hinge part 53 having the hanger protrusions 52 is bent upwardly, so as to prevent interference of the window bracket 50 when the window bracket 50 rotates.

In an assembly of the lighting device 20 of the wall-mounted type microwave oven, the window bracket 50 is first inserted into the opening 30 with the second coupling plate 54 of the window bracket 50 being inclined downwardly, such that the hanger protrusions 52 of the hinge part 53 hangs on an upper surface of the bottom panel 16. After the lamp housing 40 is temporarily held on the support pieces 60 and 70, the window bracket 50 is rotated about the hanger protrusions 52 of the window bracket 50 until the second coupling plate 54 of the window bracket 50 comes into contact with the first coupling plate 44 of the lamp housing 40. Subsequently, the screw 90 is tightened into the first coupling hole 45 of the first coupling plate 44 through the second coupling hole 55 of the second coupling plate 54, thereby completing the assembly of the lighting device. In this assembly, the temporary holding of the lamp housing 40 on the first and second support pieces 60 and 70 is achieved by a temporary holding unit, which is embodied by the hooks 71 and the hook holes 48. The final coupling of the window bracket 50 and the lamp housing 40 is achieved by a coupling unit, which is embodied by the first and second coupling holes 45 and 55 of the first and second coupling plates 44 and 54, and the screw 90.

More specifically, the window bracket 50 is first inserted into the opening 30 toward the first support pieces 60 with the second coupling plate 54 being inclined downwardly, such that the hanger protrusions 52 of the hinge part 53 are hung from the upper surface of the bottom panel 16. Thereafter, the coupling protrusions 61 of the first support pieces 60 are inserted into the coupling holes 47 of the lamp housing 40, and the lamp housing 40 is then rotated until an inner surface of the right wall 43 of the lamp housing 40 comes into contact with the outer surfaces of the second support pieces 70. Then, the right upper portion of the lamp housing 40 is pushed downwardly by a hand of a worker. Upon pushing the lamp housing 40, the hooks 71 of the second support pieces 70 are snapped into the hook holes 48 of the lamp housing 40, thereby fulfilling the temporary holding of the lamp housing 40.

After the lamp housing 40 is temporarily held on the bottom panel 16, the bottom panel 16 is turned over, causing the upper surface of the bottom panel 16 to face downwardly. In this state, the lamp housing 40 can be held on the bottom panel 16 by the temporary holding unit, that is, by the hooks 71 and the hook holes 48, without additional screws (i.e., screw 90).

Subsequently, the window bracket 50 is rotated toward the second support pieces 70 about hanger protrusions 52 hung on the bottom panel 16 adjacent to the first support pieces 60, causing the second coupling plate 54 of the window bracket 50 to contact the first coupling plate 44 of the lamp housing 40. Thereafter, the screw 90 is tightened into the first coupling hole 45 of the first coupling plate 44 through the second coupling hole 55 of the second coupling plate 54 to couple the window bracket 50 to the lamp housing 40, thereby completing the assembly of the lighting device 20.

As described above, a wall-mounted type microwave oven equipped with a lighting device in which a lamp housing is temporarily holdable on a bottom panel of an oven body by a temporary holding unit comprising hooks of the bottom panel and hook holes of the lamp housing, without fastening with screws. A window bracket are couplable to the lamp housing by a coupling unit comprising coupling holes formed at first and second coupling plates of the widow bracket and the lamp housing, respectively, and a screw. Further, the lamp housing and the window bracket are couplable to the bottom panel of the oven body by the temporary holding unit and the coupling unit. Therefore, the wall-mounted type microwave oven can ease the assembly of the lighting device and reduce manufacturing costs due to a reduction in a number of screws to be used.

Although a few preferred embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A wall-mounted microwave oven comprising:

an oven body having a bottom panel;

a lighting device including:

an opening formed at the bottom panel;

a lamp housing mounted on the bottom panel to cover the opening and having a lamp therein;

a window bracket provided at the opening and having a transparent window thereon;

a holding unit releasably holding the lamp housing on the bottom panel; and a coupling unit coupling the window bracket to the lamp housing;

first and second support pieces provided at first positions at the bottom panel, adjacent to opposite ends of the opening and extending toward the lamp housing;

coupling protrusions provided at first positions on respective first support pieces;

coupling holes provided at positions corresponding to the first positions of the coupling protrusion on the lamp housing;

hooks provided at second positions on respective second support pieces; and hooks holes provided on the lamp housing at positions corresponding to the second positions of the hooks;

wherein pairs of the coupling protrusions and the corresponding coupling holes and pairs of the hooks and the corresponding hook holes releasably couple the lamp housing to the bottom panel.

2. The microwave oven as set forth in claim 1, further comprising: two or more support pieces provided at the bottom panel, adjacent to opposite ends of the opening and extending toward the lamp housing, wherein the holding unit comprises hooks formed at one of the lamp housing and the support pieces, and hook holes formed at a remaining one of the lamp housing and the support pieces.

3. The microwave oven as set forth in claim 1, further comprising:

coupling plates provided at the lamp housing and the window bracket, wherein the coupling unit comprises coupling holes formed at the coupling plates provided at the lamp housing and the window bracket, and a screw to be tightened into the coupling holes.

4. The microwave oven as set forth in claim 1, wherein the coupling holes of the lamp housing are respectively larger than the corresponding coupling protrusions to allow the lamp housing to be rotated about the coupling protrusions.

5. The microwave oven as set forth in claim 1, wherein the window bracket comprises:

a hinge part provided at one end of the window bracket and having a pair of hanger protrusions, the hinge part being bent so as to prevent interference of the window bracket when the window bracket rotates about the hinge part.

6. A wall-mounted microwave oven including an oven body having a bottom panel comprising:

a lighting device including:

a housing to couple to the bottom panel;

a holding unit to releasably hold the housing on the bottom panel;

a light source disposed within the housing;

a cover bracket to cover the housing and having a translucent cover thereon; and a coupling unit coupling the cover bracket to the housing; and first and second support pieces provided at first positions at the bottom panel, adjacent to opposite ends of the housing and extending toward the housing;

coupling protrusions provided at first positions on respective first support pieces;

coupling holes provided at positions corresponding to the first positions of the coupling protrusion on the housing;

hooks provided at second positions on respective second support pieces; and hook holes provided on the housing at positions corresponding to the second positions of the hooks, wherein pairs of the coupling protrusions and the corresponding coupling holes and pairs of the hooks and the corresponding hook holes releasably couple the housing to the bottom panel.

7. The microwave oven as set forth in claim 6, wherein the holding unit comprises:

a plurality of support pieces provided at the bottom panel, adjacent to opposite ends of the housing and extending toward the housing;

wherein one of the housing and the plurality of the support pieces have hooks formed thereon and a remaining one of the housing and the plurality of the support pieces have corresponding hook holes formed therein to couple the housing to the bottom panel.

8. The microwave oven as set forth in claim 6, wherein the coupling unit comprises first and second coupling plates provided at the housing and the cover bracket, respectively;

a first coupling hole formed in the first coupling plate;

a second coupling hole, corresponding to the first coupling hole, formed in the second coupling plate; and a holding member to hold the cover bracket to the housing by the first and second coupling holes.

9. The microwave oven as set forth in claim 6, wherein the coupling holes of the housing are respectively larger than the corresponding coupling protrusions to allow the lamp housing to be rotated about the coupling protrusions.

10. The microwave oven as set forth in claim 6, wherein the cover bracket comprises:

a hinge part provided at one end of the cover bracket and having a pair of hanger protrusions, the hinge part being bent so as to prevent interference of the cover bracket when the cover bracket rotates about the hinge part.

11. A wall-mounted microwave oven including an oven body having a bottom panel comprising:

a lighting device comprising:

a housing to couple to the bottom panel;

a holding unit to releasably hold the housing on the bottom panel;

a light source disposed within the housing;

a cover bracket to cover the housing and having a translucent cover thereon; and a coupling unit coupling the cover bracket to the housing, wherein the holding unit includes a plurality of support pieces provided at the bottom panel, adjacent to opposite ends of the housing and extending toward the housing, wherein one of the housing and the plurality of the support pieces have hooks formed thereon and a remaining one of the housing and the plurality of the support pieces have corresponding hook holes formed therein to couple the housing to the bottom panel, and wherein the holding unit is released by depressing each of the hooks of the plurality of support piece to decouple the housing from the bottom panel.

12. A wall-mounted microwave oven including an oven body having a lighting device coupled thereon, the lighting device including a housing and a light source held therein, comprising:

a holding unit to releasably hold the housing on the oven body; and a coupling unit coupling a cover bracket to the housing, wherein the holding unit includes:

a plurality of support pieces coupled to the oven body, adjacent to opposite ends of the housing and extending toward the housing, wherein one of the housing and the plurality of the support pieces have hooks formed thereon and a remaining one of the housing and the plurality of the support pieces have corresponding hook holes formed therein to couple the housing to the oven body, and wherein the holding unit is released by depressing each of the hooks of the plurality of support piece to decouple the housing from the oven body.

13. The microwave oven as set forth in claim 12, wherein the coupling unit comprises first and second coupling plates provided at the housing and the cover bracket, respectively;

a first coupling hole formed in the first coupling plate;

a second coupling hole, corresponding to the first coupling hole, formed in the second coupling plate; and a holding member to hold the cover bracket to the housing by the first and second coupling holes.

* * * * *

UNITED STATES PATENT AND TRADEMARK OFFICE

CERTIFICATE OF CORRECTION

PATENT NO. : 6,949,730 B2
APPLICATION NO. : 10/309816
DATED : September 27, 2005
INVENTOR(S) : Se-Hun Lee et al.

It is certified that error appears in the above-identified patent and that said Letters Patent is hereby corrected as shown below:

On the Title Page, Column 2, line 3, U.S. Patent Documents, replace "Iida et al." with --Kobayashi et al.--.

Signed and Sealed this

First Day of August, 2006

JON W. DUDAS
*Director of the United States Patent and Trademark Office*